United States Patent [19]

Daniels

[11] Patent Number: 4,482,814

[45] Date of Patent: Nov. 13, 1984

[54] LOAD-FREQUENCY CONTROL SYSTEM

[75] Inventor: James H. Daniels, North Wales, Pa.

[73] Assignee: General Signal Corporation, Stamford, Conn.

[21] Appl. No.: 543,721

[22] Filed: Oct. 20, 1983

[51] Int. Cl.[3] ..... F01K 13/02

[52] U.S. Cl. ..... 290/40 B; 60/660

[58] Field of Search ..... 290/40 B, 40 C, 51, 290/34, 17; 60/660–667

[56] References Cited

U.S. PATENT DOCUMENTS

| | | | |
|---|---|---|---|
| 2,773,994 | 3/1953 | Cohn | 60/665 |
| 3,545,207 | 7/1969 | Barber et al. | 60/664 |
| 3,802,189 | 4/1974 | Jenkins, Jr. | 60/665 |
| 3,896,623 | 7/1975 | Daniels | 60/665 |
| 3,928,972 | 12/1975 | Osborne | 60/660 |
| 4,005,581 | 2/1977 | Aanstad | 60/660 |

*Primary Examiner*—E. A. Goldberg
*Assistant Examiner*—A. Evans
*Attorney, Agent, or Firm*—William G. Miller, Jr.; Harold Huberfeld

[57] ABSTRACT

This invention provides for regulating the generation of a generator at a local power station whose governor receives control signals from a central load dispatcher effective to change the generation so long as there is a change in generation required to meet desired system conditions and wherein a signal representative of actual generation of the generator is fed back to the load dispatchers office. The improvement provides means for producing a signal representative of the ratio of the throttle pressure set point to the actual throttle pressure as well as means for multiplying the signal representative of actual generation by that ratio and supplying the product as the sole feedback to the load dispatcher for determining the control signals to the governor.

3 Claims, 1 Drawing Figure

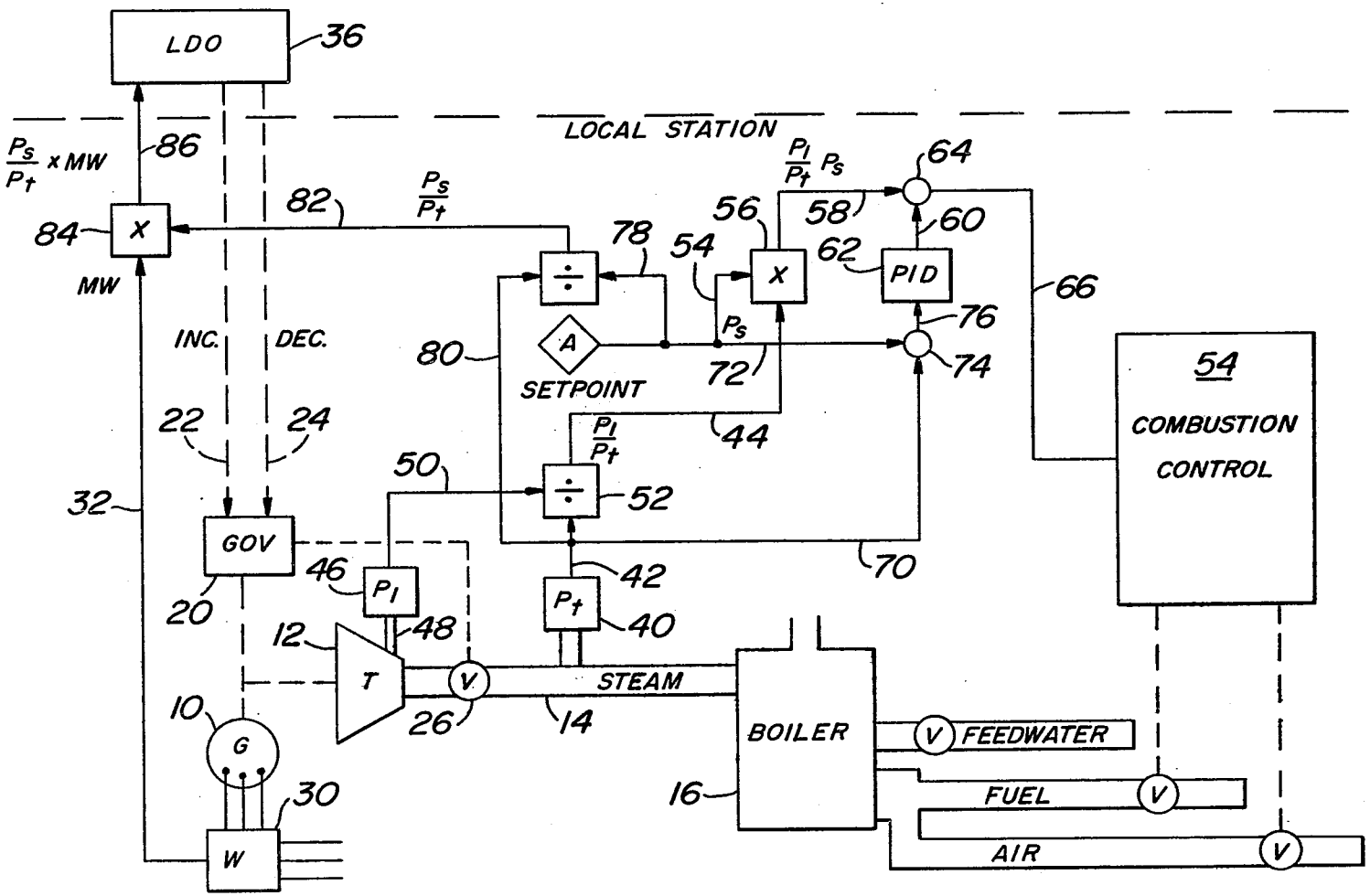
54
COMBUSTION CONTROL
66
64
60
PID
76
74
70
58
62
LOCAL STATION
56
54
72
44
78
SETPOINT
52
42
40
STEAM
14
16
BOILER
FEEDWATER
FUEL
AIR
80
50
48
26
46
12
T
36
82
DEC.
24
GOV
30
LDO
86
INC.
22
20
10
G
W
84
MW
32

LOAD-FREQUENCY CONTROL SYSTEM

BACKGROUND OF THE INVENTION

This invention relates to a means for controlling the generation of electrical generating units at interconnected local power plants where the governors respond to increase or decrease signals sent from a central load dispatchers office in accordance with the generation change requirements for the local stations as required to maintain certain conditions in the power system, such as the generation required at each station to maintain its own load at the desired system frequency.

In the control of generation at local power plants the changes in generation called for by the control frequently causes a change in the throttle pressure of the associated boiler system. For example, if there is a call for an increase in output from a generator the control will open the throttle valve to allow increased steam flow from the associated boiler. The increased steam flow will in turn cause a decrease in the steam pressure at the boiler output. When the output of the generator has increased due to the additional steam flow so as to satisfy the requirements of the load dispatcher, the steam pressure will frequently still be at a reduced value as a result of the slow response of the boiler controls to the new requirements. Then, as the steam pressure recovers due to the steam pressure control modifying the boiler inputs, the generation will increase beyond the desired value. That increase will in turn require a readjustment of the governor until there is provided the desired generator output with the steam pressure at its set point.

When there is no control loop at the local station to maintain a tight control on the generation independently of the steam pressure variations, there is required a control system which can compensate for the changes in steam pressure so as to make the generation control independent of the steam pressure variations. It is therefore an object of this invention to provide a control system for controlling the generation of local generators so as to prevent overcorrection by the combustion control system and thus make the generation control more stable by making it insensitive to changes is steam pressure.

SUMMARY OF THE INVENTION

To achieve the objects of this invention an improved control system is provided for regulating the generation of a generator at a local power station whose governor receives control signals from a central load dispatcher effective to change the generation so long as there is a change in generation required to meet desired system conditions and wherein a signal representative of actual generation of the generator is fed back to the load dispatchers office. The improvement provided comprises means for producing a signal representative of the ratio of the throttle pressure set point to the actual throttle pressure as well as means for multiplying the signal representative of actual generation by said ratio and supplying the product as the sole feedback to the load dispatcher for determing the actual generation level for said generator which will obtain when steam pressure is at its set point.

BRIEF DESCRIPTION OF THE DRAWING

The sole FIGURE is a block diagram of one form of the control system of this invention.

DESCRIPTION OF THE PREFERRED EMBODIMENT

In the FIGURE the generator 10 of the local station illustrated is driven by turbine 12 in response to the steam flow in steam line 14 supplied from boiler 16. The generator 10 is under the control of governor 20 which responds to the control pulses on lines 22 and 24 to respectively increase or decrease the output of the generator by adjustment of the throttle valve 26 in steam line 14.

As will be evident from the drawing the output of the generator is measured by the wattmeter 30 to provide on line 32 a signal representative of the generator output in megawatts, for example. In prior art devices the signal on line 32 was normally sent as a feedback to the load dispatcher's office (LDO), such as 36 which would be located at some distance thus requiring that the signal on line 32 be telemetered to the LDO.

As is well known in the art the load dispatcher's office usually utilizes instrumentation similar to that shown in U.S. Pat. No. 2,773,994, incorporated herein by reference, for determining the deviation or error between the total actual generation and that required to maintain the system load at a specific frequency, such as 60 hertz, while satisfying the demands of the interconnected systems with which the system of interest is associated. This deviation or error is known as the Area Control Error or Area Requirement. The LDO 36 then sends out to each station or generator either increase or decrease signals on lines such as 22 and 24 which respectively cause the governor 20 to change the setting of throttle valve 26 to either increase or decrease the steam flow in line 14 in order to change the generation of generator 10 to bring it equal to the desired value established at the LDO.

As has been mentioned, the change in the setting of valve 26 will cause a change in the steam flow and a corresponding change in the steam pressure in steam line 14 as measured by instrument 40, which provides on line 42 a signal representative of this pressure, known as the throttle pressure, Pt. To establish a signal on line 44 representative of the power demand for the turbine 12 there is a measurement made of the first stage pressure in turbine 12, which is indicative of the steam flow in the turbine. This is measured by the instrument 46 which is connected to the first stage by the pipe 48. The signal on line 50 is then P1, the first stage pressure. By dividing P1 by Pt in divider 52 the signal on line 44 is obtained. That signal is then used as a basis for the combustion control represented by block 54 which controls the fuel and air input to the boiler, as shown. The signal on line 44 is modified by the throttle pressure set point Ps on line 54 derived from a manually set value. Thus, as shown in the drawing, the multiplier 56 produces an output on line 58 representative of the value (P1*Ps)/Pt which is added to the signal on line 60 from controller 62 by the adder 64 to produce on line 66 a modified demand signal indicative of the required boiler inputs for guiding the operation of the combustion control 54. The combustion control system may be like that shown in U.S. Pat. No. 3,896,623 issued to me on July 29, 1975 and incorporated herein by reference.

The pressure controller 62 receives as its inputs the signal on line 70 representative of the throttle pressure Pt and the signal on line 72 representative of the throttle pressure set points Ps. Those signals are compared in comparator 74 to provide the error signal input to controller 62 on line 76. Pressure deviation is therefore taken into account in the combustion control by the action of the signal on line 60 as it modifies the signal on line 58.

In accordance with the present invention the signal on line 78, Ps, is divided by the signal on line 80, Pt, to provide on line 82 a signal for modifying the feedback signal which goes to the LDO to indicate the magnitude of the generation from generator 10. Thus the signal on line 82 is multiplied by the signal on line 32 in multiplier 84 to produce on line 86 a signal representing a modified value of the generation of the generator 10 in that it represents the value of generation which will exist when the throttle pressure is at its set point. Since the load dispatcher's office receives only a signal representing the generation when the steam pressure is at its set point, the control from the LDO as it is exerted on the governor and in turn the combustion control will not cause any change in the firing rate of the boiler that will not be compatible with the required rate when the boiler is producing steam at the desired pressure. Thus, control system instabilities can be avoided.

What is claimed is:

1. In a control system for regulating the generation of a governor controlled turbine driven generator at a local power station of an interconnected group of stations wherein the control system provides from a load dispatcher control signals to the governor which continually change the generation so long as there is a change in generation required to meet the desired system conditions and inputs to a boiler supplying steam to the turbine are modified by a pressure controller responding to deviations of the turbine throttle pressure from its desired value and wherein a signal representative of the actual generation of said generator is fed back to the load dispatcher to enable determination as to when a required level of generation is reached by said generator, the improvement comprising:

means for producing a signal representative of the ratio of throttle pressure set point to actual throttle pressure; and means for multiplying the signal representative of acutal generation by said ratio and supplying the resulting product as the sole feedback to the load dispatcher for determining an allocation of control signals to said generator.

2. In a control system for regulating the generation of an individual governor controlled turbine driven generator being supplied with steam from a boiler through a steam line at a throttle pressure where the generator is in a local power station under the control of a remote load dispatcher's office designed to send out increase or decrease pulses to the governor as long as the generator is not operating at its desired level of output as established by said load dispatcher's office from a feedback signal representative of the actual generation of said generator, and wherein said control system includes a combustion control system having a pressure control for controlling to a set point said throttle pressure for the boiler, the improvement comprising:

means for measuring the throttle pressure and producing a signal proportional thereto;

means for providing a signal representative of the set point for said throttle pressure; and means for modifying the feedback signal in accordance with the ratio of the throttle pressure signal to said throttle pressure set point signal.

3. Apparatus as set forth in claim 2 in which the means for modifying the feedback signal includes:

a multiplier for multiplying said ratio by said feedback signal.

* * * * *